US006863383B2

(12) United States Patent
Takahashi

(10) Patent No.: US 6,863,383 B2
(45) Date of Patent: Mar. 8, 2005

(54) PIEZOELECTRIC TRANSDUCER AND INK EJECTOR USING THE PIEZOELECTRIC TRANSDUCER

(75) Inventor: Yoshikazu Takahashi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 10 days.

(21) Appl. No.: 10/334,422

(22) Filed: Dec. 30, 2002

(65) Prior Publication Data

US 2003/0142173 A1 Jul. 31, 2003

(30) Foreign Application Priority Data

Jan. 30, 2002 (JP) ..... 2002-021922

(51) Int. Cl.[7] ..... B41J 2/045
(52) U.S. Cl. ..... 347/72
(58) Field of Search ..... 347/68–72; 310/365, 310/366

(56) References Cited

U.S. PATENT DOCUMENTS 5,266,964 A 11/1993 Takahashi et al.

6,174,051 B1 1/2001 Sakaida

*Primary Examiner*—Michael S. Brooke
(74) *Attorney, Agent, or Firm*—Reed Smith LLP

(57) ABSTRACT

A piezoelectric transducer is provided with a first set of electrodes spaced in a thickness direction of the piezoelectric ceramic layers, and a second set of electrodes spaced in a direction along a plane of the piezoelectric ceramic layers. The first set of electrodes defines therebetween a first area, and the second set of electrodes defines therebetween second areas one on each side of the first area. The first area is substantially level with the second areas. The first and second areas are polarized in the thickness direction of the piezoelectric ceramic layers. Upon application of a drive voltage to the first and second sets of electrodes, an electric field is generated in each of the second areas perpendicular to the polarization direction and each of the second areas is obliquely deformed by a piezoelectric shear effect, and an electric field is generated in the first area parallel to the polarization direction and the first area is deformed by a piezoelectric longitudinal effect to increase the thickness of the piezoelectric ceramic layers.

25 Claims, 10 Drawing Sheets

PIEZOELECTRIC TRANSDUCER AND INK EJECTOR USING THE PIEZOELECTRIC TRANSDUCER

BACKGROUND OF THE INVENTION

1. Field of Invention

The invention relates to a piezoelectric transducer and an ink ejector using a piezoelectric transducer.

2. Description of Related Art

A piezoelectric ink ejector has been conventionally proposed for a printhead. In a drop-on-demand ink ejector, a piezoelectric transducer deforms to change the volume of an ink channel containing ink. Ink in the ink channel is ejected from a nozzle when the volume is reduced, while ink is drawn into the ink channel when the volume is increased. Typically, a number of such ink ejecting mechanisms are disposed adjacent to each other, and ink is selectively ejected from an ink ejecting mechanism located in a particular position to form desired characters and images.

In a conventional piezoelectric ink ejector, one piezoelectric transducer is used for each ink ejecting mechanism. In that case, if many ink ejecting mechanisms are clustered to print an image over a wide range at high resolution, the ink ejector becomes complicated in structure and expensive to manufacture. In addition, it is hard to downsize each ejecting mechanism because the piezoelectric transducer cannot be made smaller due to machining constraints. Thus, the resolution is limited in such an ink ejector.

To address the forgoing problems, a single piezoelectric transducer disposed across a plurality of ink channels has recently been proposed for a piezoelectric ink ejector. A portion of the single piezoelectric transducer corresponding to a particular ejecting mechanism is locally deformed. Such a piezoelectric ink ejector is disclosed in U.S. Pat. No. 5,266,964. A piezoelectric ink ejector that has the same operation principle as the ink ejector disclosed in that patent is shown in FIG. 16.

FIG. 16 is a sectional view of a conventional piezoelectric ink ejector 501. As shown in FIG. 1, the piezoelectric ink ejector 501 includes a piezoelectric transducer 500 disposed across a plurality of ink chambers 60 to change the volume of the ink chambers 60. The piezoelectric transducer 500 is formed by laminating piezoelectric ceramic layers 510 while sandwiching inner-electrodes 530, 540 therebetween.

The piezoelectric ceramic layers 510 are polarized in directions shown by arrows 550, parallel to the laminating direction. Inner center electrodes 530 are placed at the center of each ink channel 60, and inner side electrodes 540*a*, 540*b* are placed on both sides of each ink channel 60.

When an ink droplet is ejected from an ink channel 60*a* based on predetermined print data, a drive voltage is applied to the side inner electrodes 540*a*, 540*b* and to the inner center electrodes 530*a*. In this case, the inner center electrodes 530*a* has a positive potential while the inner side electrodes 540*a*, 540*b* are grounded. Accordingly, electrical fields are generated in areas of the piezoelectric ceramic layers 510 sandwiched between the inner center electrodes 530*a* and the inner side electrodes 540*a*, 540*b*, in directions shown by dashed arrows 551, perpendicular to the polarization directions (shown by solid arrows 550). As a result, the two areas in the piezoelectric ceramic layers 510 are deformed symmetrically by a shear effect, and the inner center electrodes 530*a* are shifted upwardly in FIG. 16, thereby increasing the volume of the ink channel 60*a*. At this time, ink is supplied from an ink source (not shown) to the ink channel 60. Thereafter, when the application of the drive voltage is stopped, the deformed piezoelectric ceramic layers 510 return to the initial state. Thus, the volume of the ink channel 60*a* is reduced, and an ink droplet 520 is ejected from the ink channel 60*a* through a nozzle 50*a*.

The piezoelectric ink ejector that incorporates a piezoelectric transducer structured as described above is easy and inexpensive to manufacture and able to accomplish high-resolution printing.

However, in the above-described piezoelectric ink ejector, when the required ink droplet volume and the required ink ejecting velocity are fixed, the required drive voltage is determined by the spaces between the inner center electrodes 530 and the inner side electrodes 540, 540. Thus, the drive voltage cannot be lowered as desired, and the costs of a power source and a driving circuit board will be relatively high. In addition, when the drive voltage is fairly high, the polarization property of the piezoelectric transducer 500 tends to deteriorate due to the drive voltage being applied perpendicularly to the polarization direction, and the lifespan of the ink ejector will be shortened.

If the spaces between the inner center electrodes 530 and the inner side electrodes 540, 540 are lessened to lower the drive voltage, locally deformable areas in the piezoelectric transducer 500 are reduced, and the amount of change in the volume of the ink channel 60 is also reduced. Because of such structural limitations, it is hard to lower the drive voltage.

U.S. Pat. No. 6,174,051 and Japanese Laid-Open Patent Publication No. 10-58675 disclose another piezoelectric transducer, in which a piezoelectric ceramic layer deformable by a piezoelectric longitudinal effect is laminated to the above-described piezoelectric transducer 500 such that the piezoelectric ceramic layers are deformed greatly by a piezoelectric longitudinal effect as well as a piezoelectric shear effect. However, because each layer is deformable by either one of the effects, one layer deformed locally by one of the effect pushes a non-deformed area of another layer, thereby producing a combined deformation in the entire piezoelectric layers. Therefore, a need exists for an improved piezoelectric transducer that is deformed more effectively by a piezoelectric longitudinal effect and a piezoelectric shear effect.

SUMMARY OF THE INVENTION

The invention provides a piezoelectric transducer that is driven with a low voltage, has high durability, and can reduce the costs of a power source and a driving circuit board. The invention also provides an ink ejector using such a piezoelectric transducer.

According to one aspect of the invention, a piezoelectric transducer includes a plurality of piezoelectric ceramic layers and a plurality of electrodes spaced in a direction along a plane of the piezoelectric ceramic layers as well as in a thickness direction of the piezoelectric ceramic layers. The plurality of electrodes includes a first set of electrodes spaced in the thickness direction of the piezoelectric ceramic layers, and a second set of electrodes spaced in the direction along the plane and in the thickness direction of the piezoelectric ceramic layers and including electrodes substantially coplanar with the electrodes of the first set. The first set of electrodes defines therebetween a first area that is polarized parallel to an opposing direction of electrodes of the first set and in the thickness direction of the piezoelectric ceramic layers. The second set of electrodes defines, between electrodes opposed in the direction along the plane of the piezoelectric ceramic layers, second areas that are polarized perpendicular to the opposing direction of the electrodes of the second set and in the thickness direction of the piezoelectric ceramic layers. The second areas are defined one on each side of the first area in the direction along the plane of the piezoelectric ceramic layer, and the second areas are substantially level with the first area. Upon application of a drive voltage to the first and second sets of electrodes, an electric field is generated in each of the second areas perpendicular to the polarization direction and each of the second areas is obliquely deformed by a piezoelectric shear effect to unidirectionally shift the first area, and an electric field is generated in the first area parallel to the polarization direction and the first area is deformed by a piezoelectric longitudinal effect to increase the thickness of the piezoelectric ceramic layers.

According to another aspect of the invention, the above-described piezoelectric transducer may further include a third set of electrodes in addition to the first and second sets of electrodes. A third set of electrodes is provided on outer surfaces of two outermost layers of the piezoelectric ceramic layers to sandwich at least the second areas, and upon application of a drive voltage to the first, second, and third set of electrodes, each of the second areas is deformed by a piezoelectric shear effect while the first area is deformed by a piezoelectric longitudinal effect.

According to another aspect of the invention, an ink ejector incorporating the above-described piezoelectric transducer is provided. A plurality of piezoelectric ceramic layers extends across a plurality of ink channels. A first set of electrodes and a second set of electrodes are provided for each ink channel. A first area is defined at substantially a center of each ink channel, and second areas are defined near both sides of each ink channel, one on each side of the first area. Upon application of a drive voltage to the first and second sets of electrodes for a selected one of the ink channels, each of the second areas is deformed by a piezoelectric shear effect while the first area is deformed by a piezoelectric longitudinal effect to increase the thickness of the piezoelectric ceramic layers, thereby changing a volume of the selected ink channel to cause ink ejection.

According to another aspect of the invention, a piezoelectric transducer includes a plurality of piezoelectric ceramic layers and a plurality of electrodes spaced in a direction along a plane of the piezoelectric ceramic layers as well as in a thickness direction of the piezoelectric ceramic layers. The plurality of electrodes includes a first set of electrodes spaced in the thickness direction of the piezoelectric ceramic layers, and a second set of electrodes spaced in the direction along the plane and in the thickness direction of the piezoelectric ceramic layers and including electrodes substantially coplanar with the electrodes of the first set. The first set of electrodes defines therebetween a first area that is polarized parallel to an opposing direction of electrodes of the first set and in the thickness direction of the piezoelectric ceramic layers. The second set of electrodes defines, between electrodes opposed in the direction along the plane of the piezoelectric ceramic layers, second areas that are polarized perpendicular to the opposing direction of the electrodes of the second set and in the thickness direction of the piezoelectric ceramic layers. The second areas are defined one on each side of the first area in the direction along the plane of the piezoelectric ceramic layer, and the upper and lower surfaces of the second areas are substantially level with the upper and lower surfaces of the first area. Upon application of a drive voltage to the first and second sets of electrodes, an electric field is generated in each of the second areas perpendicular to the polarization direction and each of the second areas is obliquely deformed by a piezoelectric shear effect to unidirectionally shift the first area, and an electric field is generated in the first area parallel to the polarization direction and the first area is deformed by a piezoelectric longitudinal effect to increase the thickness of the piezoelectric ceramic layers.

BRIEF DESCRIPTION OF THE DRAWINGS

Preferred embodiments of the invention will be described in detail with reference to the following figures, in which like elements are labeled with like numbers and the figures are not drawn to scale and in which.

DETAILED DESCRIPTION OF PREFERRED EMBODIMENTS

Figure 1:
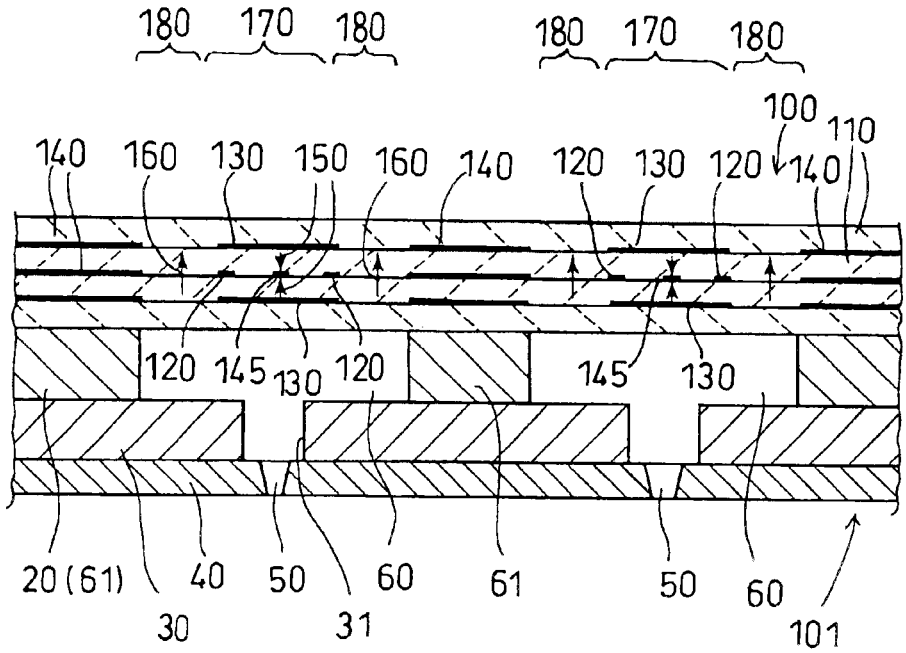
FIG. 1 is a sectional view of an ink ejector according to a first embodiment of the invention.

An ink ejector according to a first embodiment of the invention will be described with reference to FIGS. 1 through 8. FIG. 1 is a sectional view of an ink ejector 101 taken along an array of nozzles 50. As shown in FIG. 1, the ink ejector 101 includes a piezoelectric transducer 100, a first ink channel member 20, a second ink channel member 30, and a nozzle plate 40 formed with nozzles each connected to a corresponding ink channel 60.

The ink channels 60 are defined by the piezoelectric transducer 100 and the second ink channel member 30 that cover openings formed in the first ink channel member 20 from the top and bottom, respectively. Each ink channel 60 measures 0.450 mm in width (in a right-left direction in FIG. 1) and 2.000 mm in length (in a direction perpendicular to the sheet of FIG. 1). The ink channels 60 are separated by partition walls 61 and arrayed with 0.508 mm pitches (50 dpi) in the right-left direction in FIG. 1. Each ink channel 60 is connected, at its one end, to a corresponding nozzle 50 formed in the nozzle plate 40 through a connecting hole 31 formed in the second ink channel member 30 and, at its other end, to a shared ink supply source (not shown).

The piezoelectric transducer 100 is made of a piezoelectric ceramic material of lead zirconate titanate (PZT) group. The piezoelectric transducer 100 includes a plurality of piezoelectric ceramic layers 110 (for example, four layers of piezoelectric ceramic layers) having a piezoelectric and electrostrictive strain effect, and a plurality of electrodes 120, 130, 145, 140 spaced in a direction along a plane of the piezoelectric ceramic layers 110 as well as in a direction of thickness of the piezoelectric ceramic layers 110.

As shown in FIG. 1, a first area 170 provided for each ink channel 60 is defined by a first set of electrodes 130, 145, 130 that are spaced in the thickness direction of the piezoelectric ceramic layers 110.

Additionally, two second areas 180, 180 are located on both sides of the first area 170. The two second areas 180, 180 are defined by a second set of electrodes that are spaced in the direction along the plane of the piezoelectric ceramic layers 110.

A first set of electrodes includes a first electrode 145 sandwiched between the ceramic layers 110 in the middle in the laminating direction, and two opposed second electrodes 130, 130 sandwiching the first electrode 145 via the ceramic layers 110.

A second set of electrodes are divided into first and second parts. The first part includes both edges of the two opposed second electrodes 130, 130, which belong to a first set of electrodes, and two electrodes 120, 120 coplanar with and spaced from the first electrode 145. The second part of a second set of electrodes includes electrodes 140, 140 that are sandwiched between the ceramic layers 110 and spaced from the first electrode 145 and the two opposed second electrodes 130, 130. In short, a first set of electrodes and a second set of electrodes are substantially coplanar with each other.

An area defined within the widths of the two opposed second electrodes 130, 130 in the piezoelectric ceramic layers 110 is called the first area 170. The first area 170 is polarized, as shown by arrows 150 in FIG. 1, downwardly and upwardly from the two opposed second electrodes 130, 130 toward the first electrode 145. In other words, the polarization directions 150 are opposite with respect to the first electrode 145.

The two second areas 180, 180 are provided on both sides of an ink channel 60. The two second areas 180, 180 are polarized upwardly in the laminating direction of the piezoelectric ceramic layers 10.

Accordingly, the piezoelectric transducer 100 has a first area 170 located at the center of each ink channel 60 and two second areas 180, 180 adjacent to the first area 170 and located on both sides of the ink channel 60. The polarization direction of the first area 170 is parallel to the laminating direction of the piezoelectric ceramic layers 110 and reversed at the first electrode 145, as shown by solid arrows 150. Also, the polarization directions of the two second areas 180, 180 are parallel to the laminating direction, as shown by solid arrows 160.

Each piezoelectric ceramic layer 10 measures 0.015 mm in thickness. Four piezoelectric ceramic layers are laminated while the electrodes 120, 130, 140, 145 are interposed therebetween, thereby forming the piezoelectric transducer 100 having a thickness of 0.06 mm. The electrodes 120, 130, 140, 145 are made of a conductive metal of Ag—Pd group and measure about 0.002 mm in thickness. The second electrodes 130 measure about 0.020 mm in width (in the right-left direction in FIG. 1), the electrodes 120 and the first electrodes 145 measure about 0.005 mm in width, and the electrodes 140 are about 0.058 in width.

The piezoelectric transducer 100 is manufactured as described below.

Figure 2:
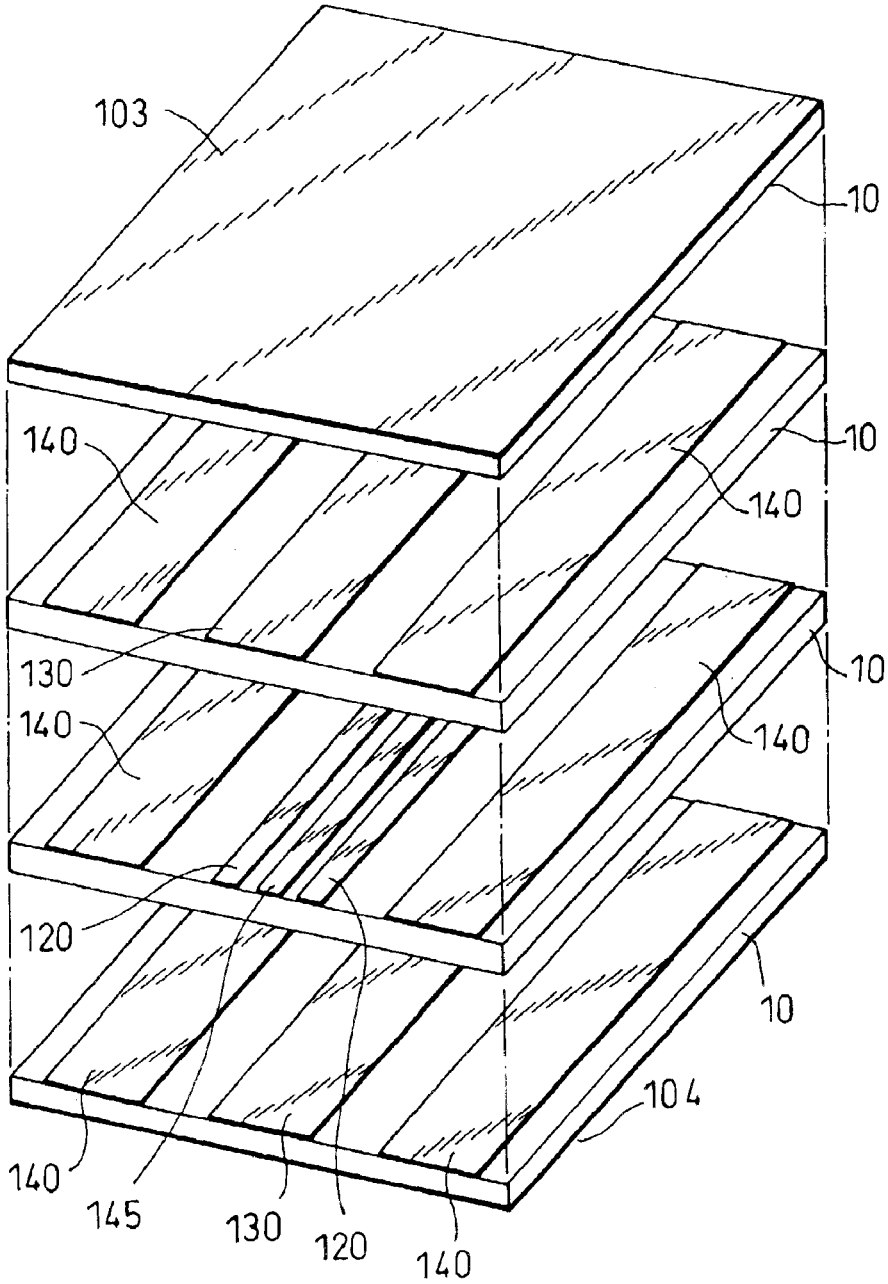
FIG. 2 is a perspective view of electrodes disposed on green sheets to be laminated in the manufacturing process of a piezoelectric transducer for the ink ejector according to the first embodiment.
Figure 3:
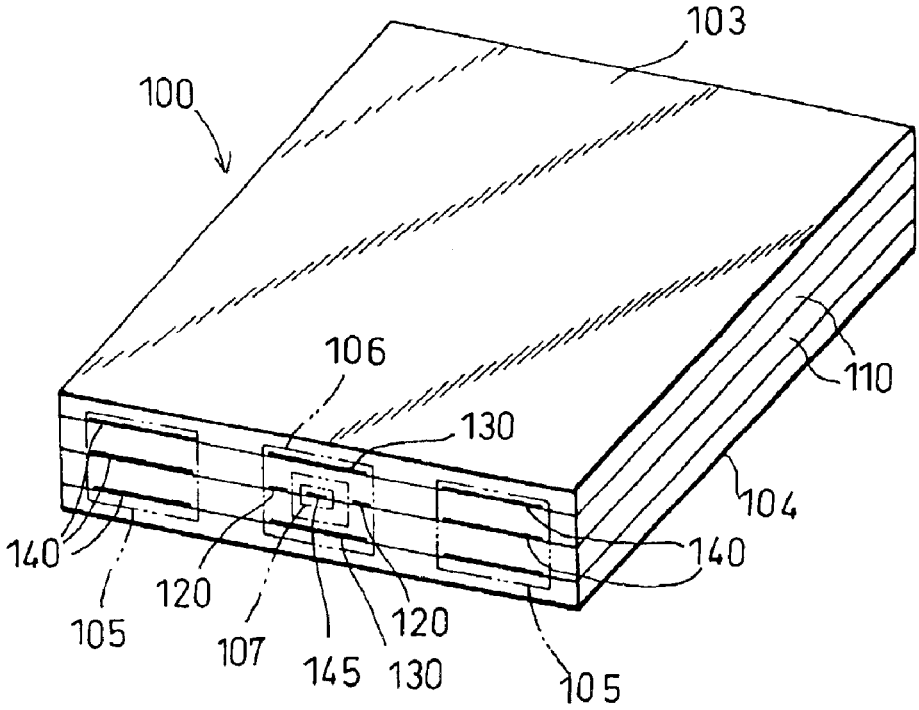
FIG. 3 is a perspective view of the laminated green sheets of the piezoelectric transducer according to the first embodiment.

Four green sheets 10 are prepared to form the piezoelectric ceramic layers 110. As shown in FIG. 2, discrete electrodes 140, 130, 140 are formed by screen-printing on the upper surfaces of the first and third green sheets 10 from the bottom. Discrete electrodes 140, 120, 145, 120, 140 are formed by screen-printing on the upper surface of the second green sheet from the bottom. Then, the four green sheets 10 are thermally pressed, degreased, and sintered as required. Thereafter, as shown in FIG. 3, polarization electrodes 103, 104 are formed on the top and bottom surfaces entirely by screen-printing, spattering, or other methods. As a result, the piezoelectric transducer 100 is obtained.

Additionally, as shown in FIG. 3, the electrodes 120, 130, 145, 140 are lead out to a periphery of the piezoelectric ceramic layers 110 (green sheets 10), and outer electrodes 105, 106, 107 are formed on the periphery of the piezoelectric ceramic layers 110. In this case, the outer electrodes 105, 106, 107, which are to be connected to grouped inner electrodes, are formed by printing and baking silver paste or spattering sliver paste. For example, as shown in FIG. 3, the ends of vertically arranged three electrodes 140 are connected to the corresponding outer electrode 105, the ends of vertically arranged two second electrodes 130 and two electrodes 120 are connected to the outer electrode 106, and the end of a first electrode 145 is connected to the outer electrode 107.

Figure 4:
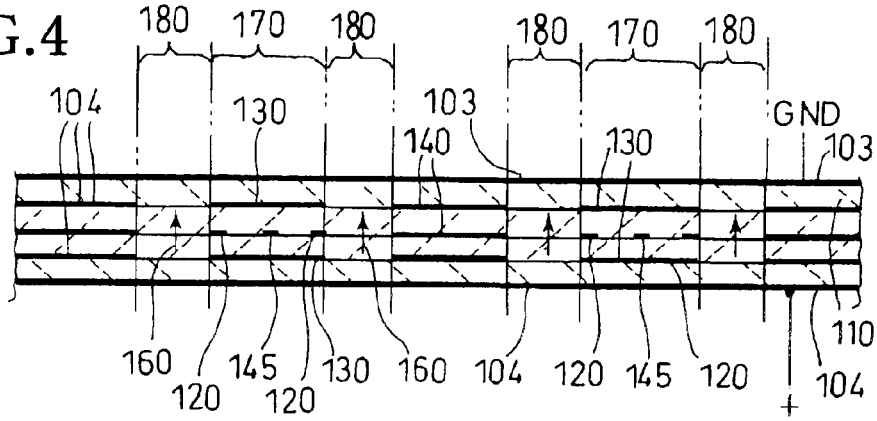
FIG. 4 is a sectional view showing the first polarization of the piezoelectric transducer according to the first embodiment.

Then, the piezoelectric transducer 100 thus obtained is immersed in an oil bath filled with an insulating oil, such as a silicon oil, heated to a temperature of about 130° C., and an electric field of about +2.5 kV/mm is applied by a polarizing power source (not shown) between the first polarization electrode 103 and the second polarization electrode 104. More specifically, polarization is performed, as shown in FIG. 4, by grounding the first polarization electrode 103 at the top while applying a positive voltage to the second polarization electrode 104 at the bottom. At this time, all the electrodes 120, 130, 140, 145 in the piezoelectric ceramic layers 110 are electrically disconnected.

As a result, the second areas 180 of the piezoelectric ceramic layers 110 are polarized, as shown by solid arrows in FIG. 4, in a direction parallel to the laminating direction, namely, in a thickness direction of the piezoelectric ceramic layers 110 (upwardly in FIG. 4).

Figure 5:
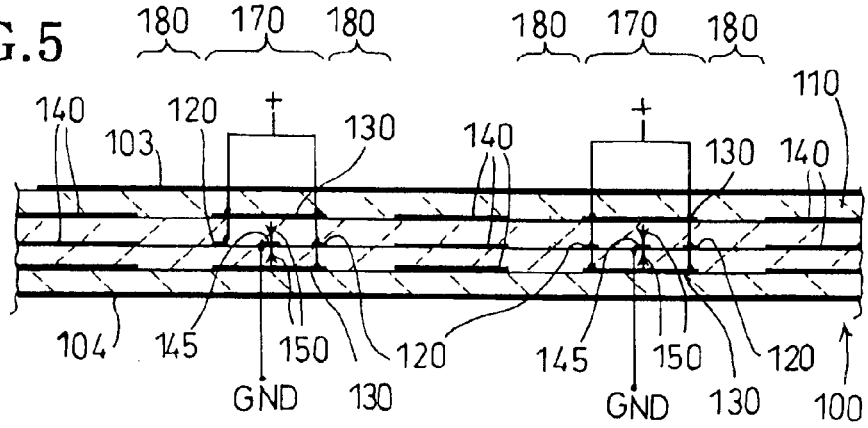
FIG. 5 is a sectional view showing the second polarization of the piezoelectric transducer according to the first embodiment.

Then, the piezoelectric transducer 100 is immersed again in the oil bath (not shown) filled with an insulating oil, such as a silicon oil, heated to a temperature of about 130° C., and an electric field of about +2.5 kV/mm is applied by the polarizing power source (not shown) between the electrodes 130 and the electrode 145 of each first set of electrodes. More specifically, polarization is performed, as shown in FIG. 5, by applying a positive voltage to the second electrodes 130 while grounding the first electrode 145. At the same time, a positive voltage is applied to the electrodes 120, 120 to prevent electric fields generated (in the laminating direction) between the second electrodes 130 and the first electrode 145 from leaking to the adjacent second areas 180. This also prevents deterioration of the previously generated polarization 160. At this time, all the electrodes 140 are electrically disconnected.

As a result, sub-areas defined in each first area 170 by the second electrodes 130 and the first electrode 145 are polarized, as shown by arrows 150 in FIG. 5, in a direction substantially parallel to the laminating direction, namely, in a thickness direction of the piezoelectric ceramic layers 110. The polarization directions are opposite with respect to the first electrode 145.

Figure 6:
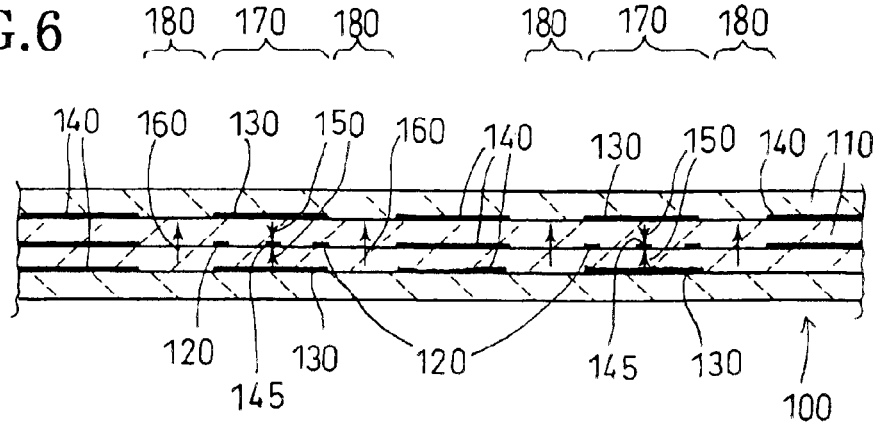
FIG. 6 is a sectional view showing removal of electrodes used for the polarization of the piezoelectric transducer according to the first embodiment.

Then, as shown in FIG. 6, the polarization electrodes 103, 104 are removed by grinding from the top and bottom of the piezoelectric transducer 100. An area between and including two opposed second electrodes 130, 130 is the above-described first area 170, and areas adjacent to the first area 170 and defined between the first area 170 and the electrodes 140, 140 are the above-described second areas 180, 180. An upper surface of the first area 170 is defined by the upper electrode 130 and a lower surface is defined by the lower electrode 130. An upper surface of the second area 180 is defined by the surface between the upper electrode 130 and an upper electrode 140 and a lower surface is defined by the surface between the lower electrode 130 and a lower electrode 140. The upper and lower surfaces of the first area 170 are substantially level with the upper and lower surfaces of the second areas 180, 180.

By unitarily assembling the first ink channel member 20, the second ink channel member 30, and the nozzle plate 40 into the piezoelectric transducer 100 thus obtained, the ink ejector 101, shown in FIG. 1, is constructed.

Figure 7:
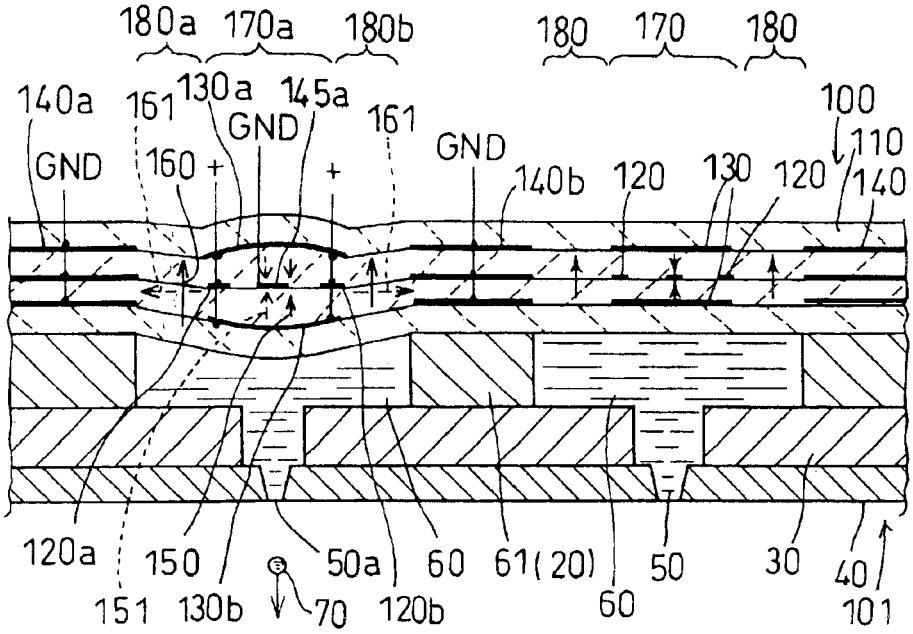
FIG. 7 is a sectional view showing the operation of the ink ejector according to the first embodiment where the piezoelectric transducer is in the initial state.

The operation of the ink ejector 101 thus constructed will now be described. In the initial state, as shown in FIG. 7, all the electrodes 120, 130, 140, 145 are grounded, and the ink channels 60 are filled with ink. When an ink droplet is to be ejected from a nozzle 50*a* connected to an ink channel 60*a* according to predetermined print data, a drive voltage (of +15 V, for example) is applied to the electrodes 120*a*, 120*b*, 130*a*, 130*b* provided over the ink channel 60*a* while the first electrode 145*a* at the center and the electrodes 140*a*, 140*b* on both sides of the ink channel 60*a* are grounded.

Upon the application of the drive voltage, electric fields are generated, as shown by dashed arrows 161 in FIG. 7, in the second areas 180*a*, 180*b* provided over the ink channel 60*a*. At the same time, electric fields are generated, as shown by dashed arrows 151, in the same directions as the polarization directions 150 in the first area 170*a*, between the two opposed second electrodes 130*a*, 130*b* and the first electrode 145*a* provided in the middle of the ceramic layers 110.

In this case, because the second electrodes 130*a*, 130*b* and the electrodes 120*a*, 120*b* are provided symmetrically with respect to the center of the thickness of the piezoelectric ceramic layers 110, the electric fields are generated effectively in the first area 170*a*. In addition, because the electrodes 120*a*, 120*b* 130*a*, 130*b* and the electrodes 140*a*, 140*b* are sandwiched between the piezoelectric ceramic layers 110, no electricity is discharged, upon the application of the drive voltage, to the outside of the piezoelectric ceramic layers 110.

Figure 8:
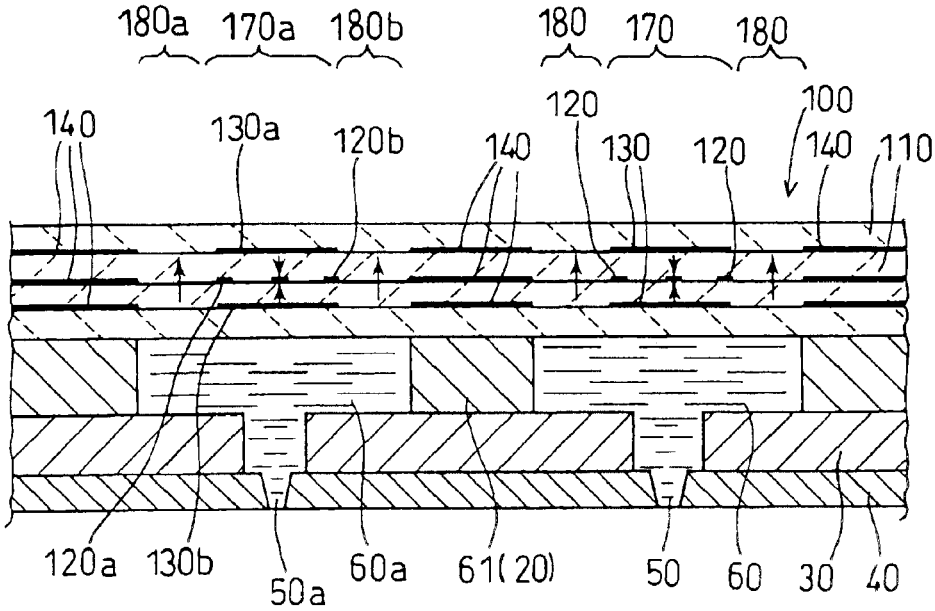
FIG. 8 is a sectional view showing the operation of the ink ejector according to the first embodiment where the piezoelectric transducer is locally deformed to eject an ink droplet.

The first area 170*a* provided over the ink channel 60*a* is deformed to expand vertically in FIG. 8 by a piezoelectric longitudinal effect produced by the electric fields 151. By contrast, each of the second areas 180*a*, 180*b* is deformed downwardly into a parallelogram shape by a piezoelectric shear effect produced by the electric field 161, thereby shifting the first area 170*a* unidirectionally (downwardly). In other words, the piezoelectric transducer 100 is deformed locally at a portion facing the ink channel 60*a* to reduce the volume of the ink channel 60*a*, as shown in FIG. 7. At this time, the pressure in the ink channel 60*a* increases, and a relatively high pressure is applied to a portion near the nozzle 50*a*, which is connected to the ink channel 60*a*. As a result, an ink droplet 70 is ejected from the nozzle 50*a*. When the voltage applied to the electrodes 120*a*, 120*b*, 130*a*, 130*b* provided over the ink channel 60*a* is reset to 0 V, the piezoelectric transducer 100 returns to the initial state. Thus, the pressure applied to the ink in the ink channel 60*a* decreases, and the ink is supplied to the ink channel 60*a* from the ink source (not shown).

As described above, in the ink ejector 101 according to the first embodiment, a first area 170 and two second areas 180, 180, which are adjacent to each other, are provided over each ink channel 60. These areas are polarized in the thickness direction of the piezoelectric ceramic layers 110. Two opposed second electrodes 130, 130 belonging to a first set of electrodes are commonly used to apply a drive voltage to the first area 170 and a drive voltage to the second areas 180, 180. By applying a positive voltage to the second electrodes 130, 130 and the electrodes 120, 120 while grounding the other electrodes, the first area 170 is deformed by a piezoelectric longitudinal effect, and the second areas 180, 180 are deformed by a piezoelectric shear effect. As a result, the second areas 180, 180 are shifted obliquely to reduce the volume of the ink channel 60. At the same time, the first area 170 expands to increase the thickness of the piezoelectric ceramic layers 110, thereby reducing the volume of the ink channel 60.

Accordingly, immediately after the application of the drive voltage in the ink ejector 101, the ink droplet 70 is ejected from the ink channel 60 through the nozzle 50.

When the drive voltage is applied to the second areas 180, 180, both edges of the second electrodes 130, 130 of a first set of electrodes and the electrodes 120, 120 interposed therebetween are used as part of a second set of electrodes with respect to the electrodes 140, 140, which are provided adjacent to the second areas 180, 180. By the sharing of the second electrodes 130, 130 for the first and second sets of electrodes, the adjacent first and second areas 180, 170, 180 can be arranged close to each other, and thus the piezoelectric transducer 100 can be made compact. Further, the electrodes 140 placed on the partition wall on either side of each ink channel are commonly used, as part of a second set of electrodes, for two adjacent ink channels. Thus, the piezoelectric transducer 100 can be made more compact.

Further, the second electrodes 130, 130 and the interposed electrodes 120, 120 are stacked one above another, and opposed to and coplanar with the electrodes 140, 140. Thus, electric fields are generated in the second areas 180, 180 substantially throughout the thickness of the piezoelectric ceramic layers 110. As a result, the second areas 180. 180 are deformed effectively by a piezoelectric shear effect.

As describe above, the second electrodes 130, 130 and the electrodes 120, 120 in the first area 170 are used to apply the drive voltage to the first area 170 as well as the second areas 180, 180. Also, the second electrodes 130, 130 isolate the first area 170 where the electric fields 151 are generated from the second areas 180*a*, 180*b* where the electric fields 161 are generated. The deformation by a piezoelectric longitudinal effect in the first area does not interfere with the deformation by a piezoelectric shear effect in each of the adjacent second areas 180, 180, and these deformations are generated side by side, at the same time. Thus, the deformation by the piezoelectric longitudinal effect in the first area 170 directly spreads outwardly. Accordingly, the ink ejector 101 can eject an ink droplet with a lower drive voltage than the drive voltage required for the conventional ink ejector.

Figure 16:
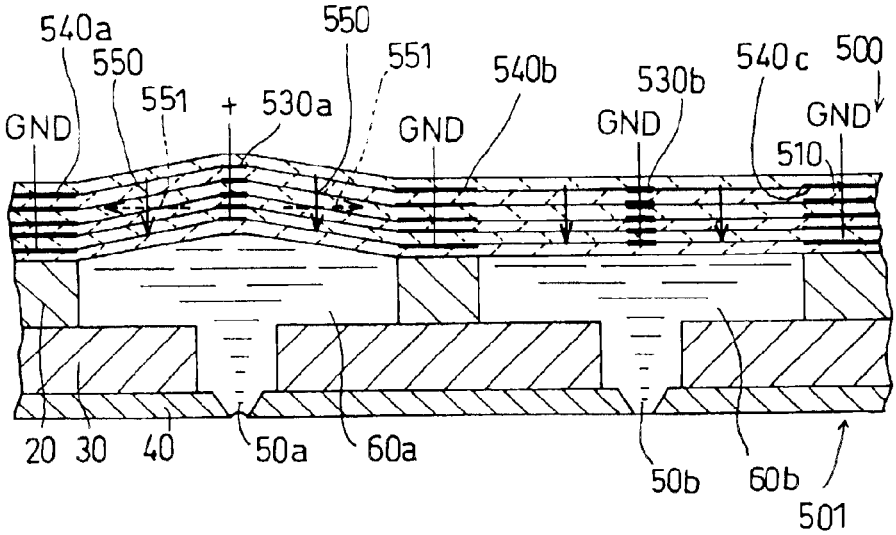
FIG.16 RELATED ART
FIG. 16 is a sectional view showing the operation of a conventional ink ejector where an piezoelectric transducer is locally deformed.
Figure 17:
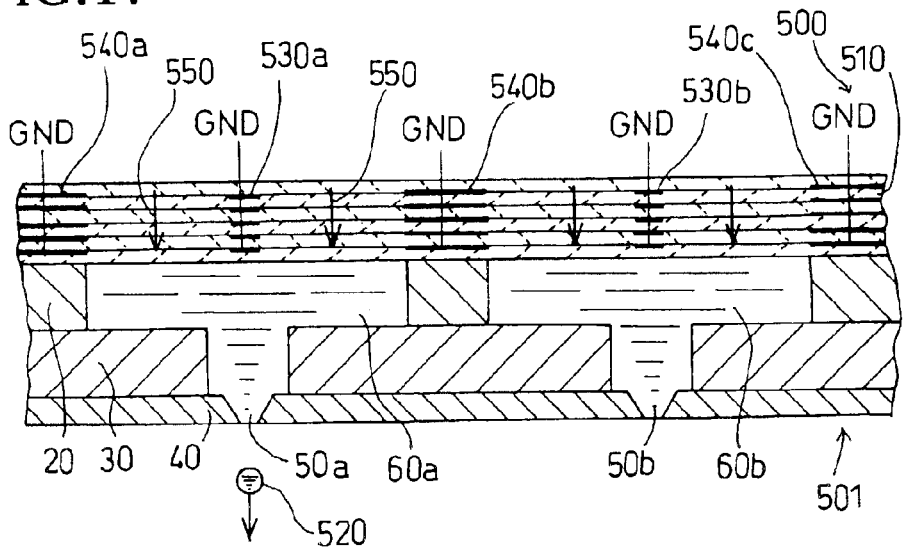
FIG.17 RELATED ART
FIG. 17 is a sectional view showing the operation of the conventional ink ejector where an ink droplet is ejected.

The spaces between the electrodes 120, 130 and the electrodes 140, that is, the surface distance of each of the second areas, can be reduced to about half as compared with the surface distance of each of the corresponding areas in the conventional piezoelectric transducer 501 of FIGS. 16 and 17. Even though the surface distance of each of the second areas 180 is substantially reduced, because a deformation of the first area 170 and deformations of the adjacent second areas 180, 180 are combined to change the volume of the ink channel 60, the amount of change in the volume in the ink channel 60 is substantially the same as that in the conventional ink-ejector 501 of FIG. 16. Accordingly, the drive voltage required for the ink ejector 101 can be reduced to about half as compared with the conventional ink ejector 501.

Two electrodes 120, 120 interposed between the second electrodes 130, 130 and a first electrode 145 may be provided on each of an odd number of piezoelectric ceramic layers 110. In this case, by applying a polarizing voltage of the same polarity to the second electrodes 130, 130, areas defined by the second electrodes 130, 130 and an odd number of first electrodes 145 are readily polarized in opposite directions alternately in the thickness direction of the piezoelectric ceramic layers 110. In addition, the piezoelectric ceramic layers 110 is readily driven by applying voltages of opposite polarity to the second electrodes 130, 130 and the corresponding electrodes 140, 140.

Figure 9:
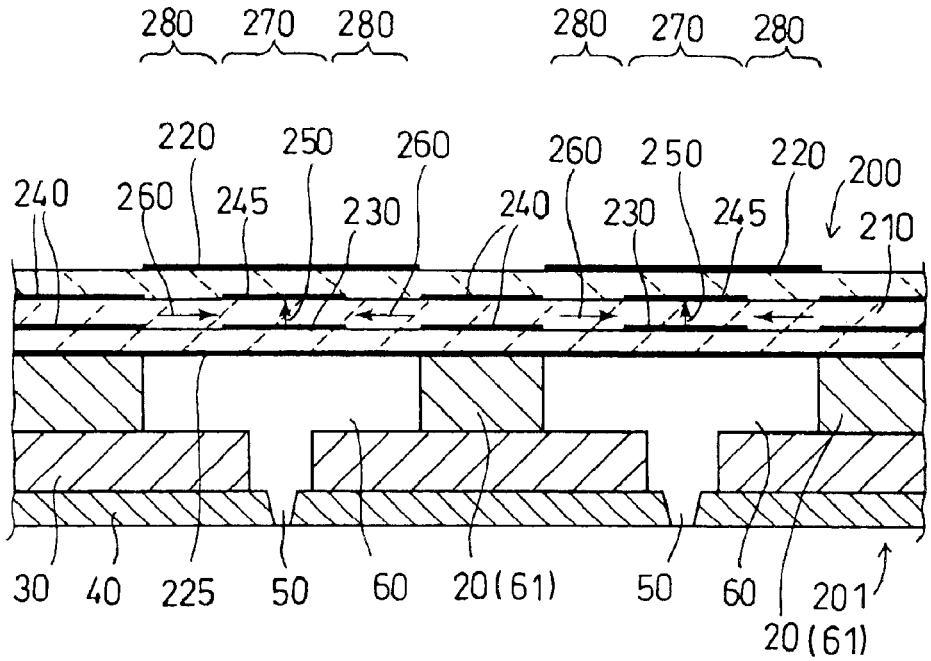
FIG. 9 is a sectional view of an ink ejector according to a second embodiment of the invention.

Referring now to FIGS. 9–15, an ink ejector according to a second embodiment of the invention will be described. FIG. 9 is a sectional view of an ink ejector 201 taken along an array of ink channels 60. As shown in FIG. 9, the ink ejector 201 includes a piezoelectric transducer 200, a first ink channel member 20, a second ink channel member 30, and a nozzle plate 40 formed with nozzles 50. The ink channels 60 are defined by the piezoelectric transducer 200, the first ink channel member 20, and the second ink channel member 30. Each ink channel 60 measures 0.450 mm in width (in a right-left direction in FIG. 9) and 2.000 mm in length (in a direction perpendicular to the sheet of FIG. 9). The ink channels 60 are arrayed with 0.508 mm pitches (50 dpi) in the right-left direction in FIG. 9. The piezoelectric transducer 200 is made of a piezoelectric ceramic material of lead zirconate titanate (PZT) group. The piezoelectric transducer 200 includes a plurality of piezoelectric ceramic layers 210 (for example, three layers of piezoelectric ceramic layers) that have a piezoelectric and electrostrictive strain effect, and a plurality of electrodes 230, 245, 240, 220, 230 spaced in a direction along a plane of the piezoelectric ceramic layers 210 as well as in a thickness direction of the piezoelectric ceramic layers 210.

As shown in FIG. 9, an electrode 230 and an electrode 245, which are provided for each ink channel 60 and spaced in the thickness direction of the piezoelectric ceramic layers 210, belong to a first set of electrodes. Electrodes 240, 240, which are provided for each ink channel 60 and spaced in the direction along the plane of the piezoelectric ceramic layers 210, belong to a second set of electrodes. A first area 270 is defined between a first set of electrodes, and two second areas 280, 280 are defined, on both side of the first area 270, between both edges of electrodes 230, 245 and adjacent electrodes 240, 240. Further, a third set of electrodes 220, 225 are provided on outermost surfaces of the piezoelectric ceramic layers 210 to oppose to each other and sandwich at least the two second areas 280, 280.

A first area 270 of the piezoelectric transducer 200 is located at the center of each ink channel 60, and two second areas 280, 280 adjacent to the first area 270 are located on both sides of the ink channel 60. Electrodes 230, 245, which belong to a first set of electrodes, are disposed nearly at the center of the first area 270, and electrodes 240, 240, which belong to a second set of electrodes, are disposed on partition walls 61 of each ink channel 60. Among a third set of electrodes, an electrode 225 is disposed on the bottom surface of the piezoelectric transducer 200 to extend across all the ink channels 60, and an electrode 220 is disposed on the top surface thereof to extend over only an associated ink channel 60. A plurality of electrodes 220 are provided on the top surface and adjacent electrodes 220, 220 are electrically insulated from each other.

Each piezoelectric ceramic layer 210 measures 0.015 mm in thickness. The three piezoelectric ceramic layers are laminated while the electrodes 230, 240, 245 are sandwiched therebetween, thereby forming the piezoelectric transducer 200 having a thickness of 0.045 mm. The electrodes 230, 240, 245 are made of a conductive metal of Ag—Pd group and measure about 0.002 mm in thickness. The electrodes 230, 245, which belong to a first set of electrodes, measure about 0.020 mm in width (in the right-left direction in FIG. 9), and the electrodes 240 measure about 0.058 mm in width.

The first area 270 is polarized, as shown by a solid arrow 250 in FIG. 9, parallel to the laminating direction of the piezoelectric ceramic layers 210, The second areas 280, 280 are polarized, as shown by solid arrows 260, perpendicular to the thickness direction of the piezoelectric ceramic layers 210 and parallel to a direction in which the electrodes 240, 240 are opposed to the first set of electrodes 230, 245.

The piezoelectric transducer 200 is manufactured as described below.

Figure 10:
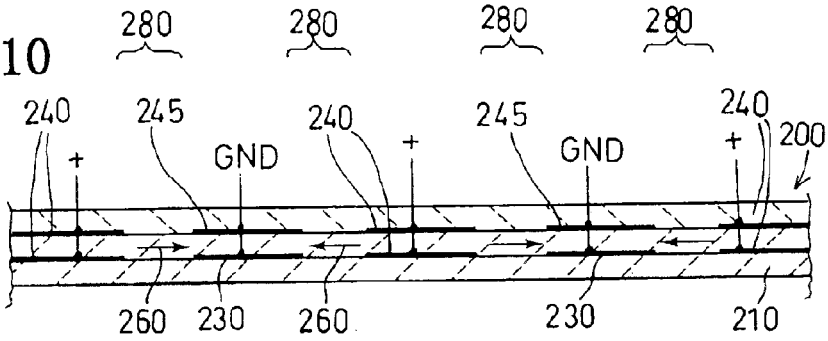
FIG. 10 is a sectional view showing the first polarization in the manufacturing process of the piezoelectric transducer for the ink ejector according to the second embodiment.
Figure 11:
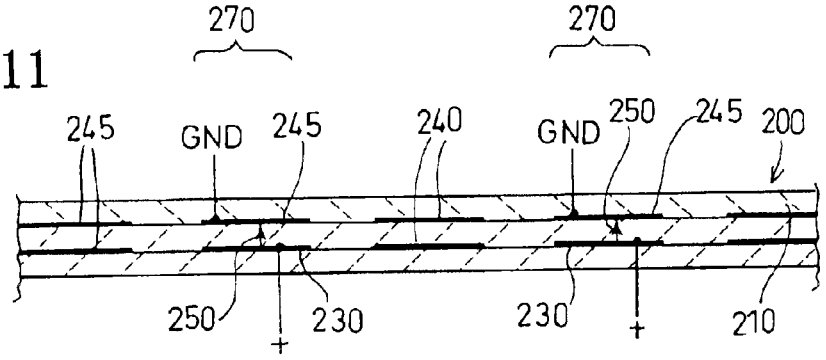
FIG. 11 is a sectional view showing the second polarization of the piezoelectric transducer according to the second embodiment.

As shown in FIG. 10, discrete electrodes 230, 240, 245 are formed by screen-printing on the upper surfaces of two green sheets. Then, a green sheet without electrodes formed thereon is laminated over the two green sheets, and the three green sheets are thermally pressed, degreased, and sintered as required. As a result, the piezoelectric transducer 200 is obtained.

Then, the piezoelectric transducer 200 thus obtained is immersed in an oil bath filled with an insulating oil, such as a silicon oil, heated to a temperature of about 130° C., and an electric field of about +2.5 kV/mm is applied by a polarizing power source (not shown) between the electrodes 240 and the electrodes 245. More specifically, polarization is performed by applying a positive voltage to the electrodes 240 while grounding the first sets of electrodes 245, 230. As a result, the second areas 280, 280 are polarized, as shown by solid arrows 260 in FIG. 10, inwardly (in a right-left/left-right direction in FIG. 10), perpendicular to a thickness direction of the piezoelectric ceramic layers 210.

In this case, both edges of the electrodes 245, 230, which belong to a first set of electrode, are used as part of a second set of electrodes with respect to the electrodes 240, 240, which are provided adjacent to the second areas 260, 260. By the sharing of the electrodes 245, 230 for the first and second sets of electrodes, the adjacent first and second areas 180, 170, 180 can be arranged close to each other. Accordingly, the piezoelectric transducer 200 can be made compact.

Then, the piezoelectric transducer 200 is immersed again in the oil bath (not shown) filled with an insulating oil, such as a silicon oil, heated to a temperature of about 130° C., and an electric field of about +2.5 kV/mm is applied by the polarizing power source (not shown) between the electrodes 245 and the electrodes 230, as shown in FIG. 1. More specifically, polarization is performed by grounding the electrodes 245 while applying a positive voltage to the electrodes 230. At the same time, the electrodes 240 are electrically disconnected. As a result, each area between the electrodes 245, 230 is polarized, as shown by a solid arrow 250 in FIG. 11, in a direction parallel to the laminating direction (in a thickness direction of the piezoelectric ceramic layers 210) upwardly toward the grounded electrode 245.

Figure 12:
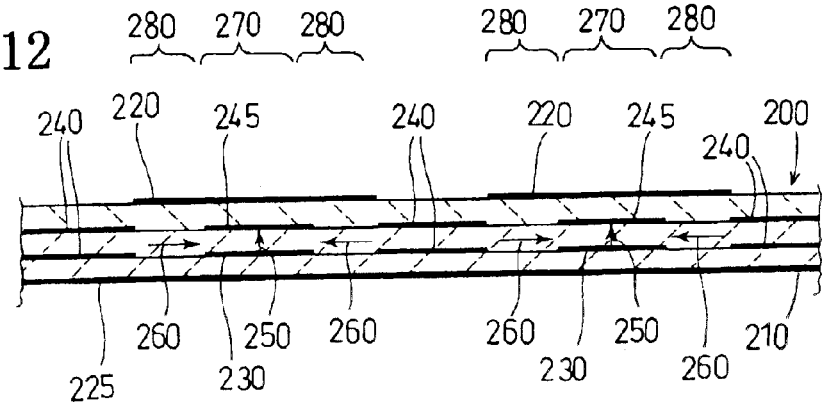
FIG. 12 is a sectional view showing fabrication of outer electrodes on the piezoelectric transducer according to the second embodiment.

Then, as shown in FIG. 12, third sets of electrodes 220, 225 are formed by screen-printing or spattering on the top and bottom surfaces of the piezoelectric transducer 200. The outer positive electrodes 220 are not formed for the portions over the electrodes 240 spaced along the array of ink channels 60.

An area sandwiched by each first set of electrodes 245, 230 is the above-described first area 270. Areas provided on both sides of the first area 270 and sandwiched by the electrodes 240, 240 and the first set of electrodes 245, 230 are the above-described second areas 280. An upper surface of the first area 270 is defined by an electrode 245 and a lower surface is defined by an electrode 230. An upper surface of the second area 280 is defined by the surface between the electrode 245 and an upper electrode 240 and a lower surface is defined by the surface between the electrode 230 and a lower electrode 240. The upper and lower surfaces of the first area 270 are substantially level with the upper and lower surfaces of the second areas 280, 280.

By unitarily assembling the first ink channel member 20, the second ink channel member 30, and the nozzle plate 40 into the piezoelectric transducer 200 thus obtained, the ink ejector 201, shown in FIG. 9, is constructed.

Figure 13:
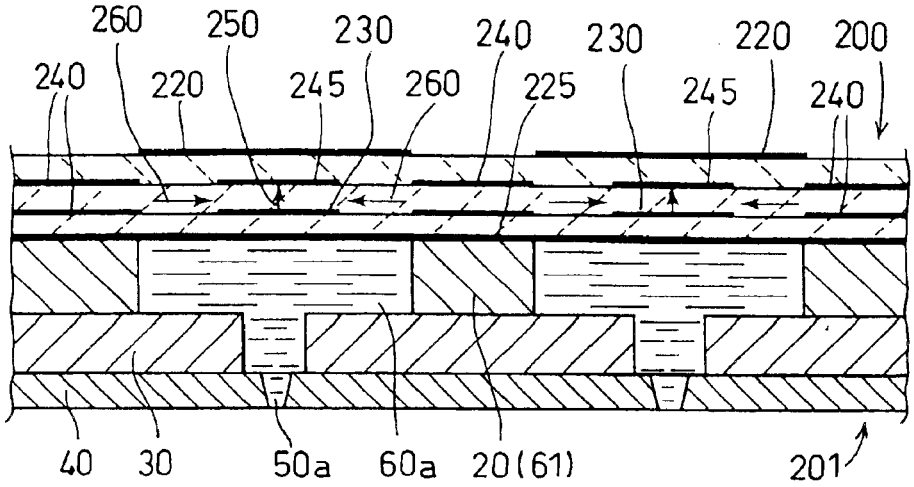
FIG. 13 is a sectional view showing the operation of the ink ejector according to the second embodiment where the ink ejector is in the initial state.

The operation of the ink ejector 201 thus constructed will be described. In the initial sate, as shown in FIG. 13, all the electrodes 230, 240, 245 and all the outer electrodes 220, 225 are grounded, and the ink channels 60 are filled with ink.

Figure 14:
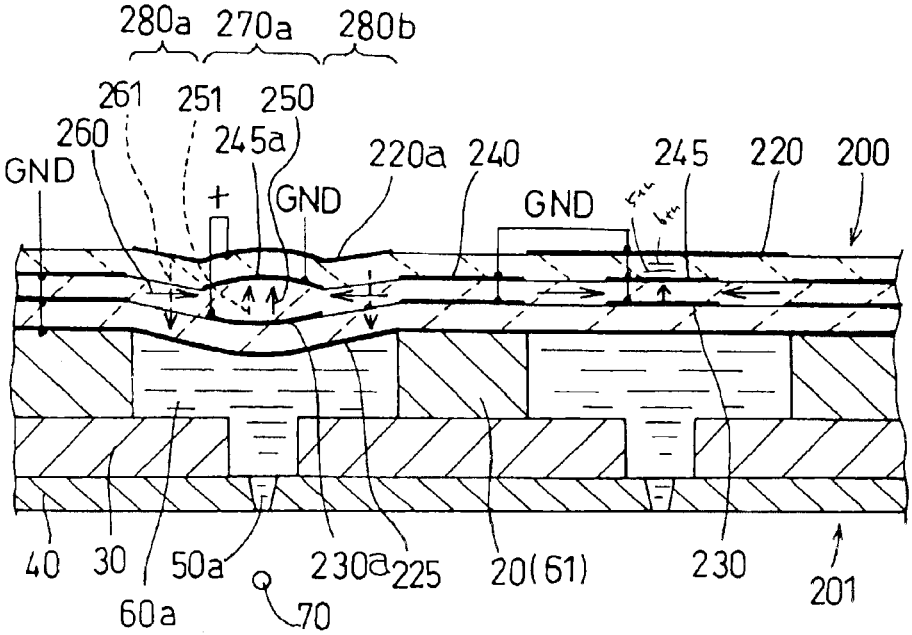
FIG. 14 is a sectional view showing the operation of the ink ejector according to the second embodiment where the piezoelectric transducer is locally deformed to eject an ink droplet.

When an ink droplet is to be ejected from a nozzle 50*a* connected to an ink channel 60*a* according to predetermined print data, a drive voltage (of +15 V, for example) is applied, as shown in FIG. 14, to an outer electrode 220*a* and an electrode 230*a*, which are provided over the ink channel 60*a*, and other electrodes 225, 240, 245 are grounded. Upon the application of the drive voltage between a first set of electrodes 230*a*, 245*a*, an electric field is generated in a first area 270*a* over the ink channel 60*a*, as shown by a dashed arrow 251, in the same direction as the polarization direction 250. At the same time, upon the application of the drive voltage between a third set of electrodes 220*a*, 225, electric fields are generated, as shown by dashed arrows 261, perpendicular to the polarization directions 260 of two second areas 280*a*, 280*b*. In this case, because the first set of electrodes 230*a*, 245*a* and the second set of electrodes 240, 240 are sandwiched between the piezoelectric ceramic layers 210, no electricity is discharged, upon the application of the drive voltage, to the outside of the piezoelectric ceramic layers 210.

Accordingly, the first area 270*a* provided over the ink channel 60*a* is deformed to increase the thickness of its central portion by a piezoelectric longitudinal effect produced by the electric field 251 generated in the same direction as the polarization directions 250. By contrast, two second areas 280*a*, 280*b* are deformed obliquely to shift the first area 270*a* downwardly in FIG. 14 by a piezoelectric shear effect produced by the electric fields 261 generated perpendicular to the polarization directions 260.

In other words, the piezoelectric transducer 200 is deformed locally at a portion facing the ink channel 60*a* to reduce the volume of the ink channel 60*a*, as shown in FIG. 14. At this time, the pressure in the ink channel 60*a* increases, and a relatively high pressure is applied to a portion near the nozzle 50*a*, which is connected to the ink channel 60*a*. As a result, an ink droplet 70 is ejected from the nozzle 50*a*. When the voltage applied to the outer electrode 220*a* and the electrode 230*a*, which are provided over the ink channel 60*a*, is reset to 0 V, the piezoelectric transducer 200 returns to the initial state shown in FIG. 13. Thus, the pressure applied to the ink in the ink channel 60*a* decreases, and the ink is supplied to the ink channel 60*a* from an ink source (not shown).

As described above, in the ink ejector 201 according to the second embodiment, a first area 270 and two second areas 280, 280 are adjacent to each other over each ink channel 60. The first area 270 is polarized in the thickness direction of the piezoelectric ceramic layers 210, and the second areas 280, 280 are polarized symmetrically from the electrodes 240, 240 toward the first area 270. By applying a positive voltage between the electrode 220 of a third set of electrodes and the electrode 230 of a first set of electrodes while grounding other electrodes, the first area 270 is deformed by a piezoelectric longitudinal effect and, at the same time, the second areas 280, 280 are deformed by a piezoelectric shear effect. As a result, the second areas 280, 280 are shifted obliquely to reduce the volume of the ink channel 60. At the same time, the first area 270 is shifted unidirectionally (downwardly) and expands to increase the thickness of the piezoelectric ceramic layers 210, thereby reducing the volume of the ink channel 60.

The deformation by a piezoelectric longitudinal effect in the first area 270 does not interfere with the deformation by a piezoelectric shear effect in each of the adjacent second areas 180, 180, and these deformations are generated side by side, at the same time. The deformation by the piezoelectric longitudinal effect in the first area 270 directly spreads outwardly. Accordingly, the ink ejector 201 can eject an ink droplet with a lower voltage than the voltage required for the conventional ink ejector.

In addition, even though the surface distance of each of the second areas 280 is substantially reduced, because a deformation of the first area 270 and deformations of the adjacent second areas 280, 280 are combined to change the volume of the ink channel 60, the amount of change in the volume in the ink channel 60 is substantially the same as that in the conventional ink-ejector 501 of FIG. 16. Accordingly, the drive voltage required for the ink ejector 201 can be reduced to about half as compared with the conventional ink ejector 501.

Further, a second set of electrodes 240, 240 are placed on the partition walls 61, 61 on both sides of each ink channel 60, and the electrodes 240 placed on the partition wall 61 on either side of each ink channel 60 are commonly used, as part of a second set of electrodes, for two adjacent ink channels. Thus, the piezoelectric transducer 200 can be made compact.

Figure 15:
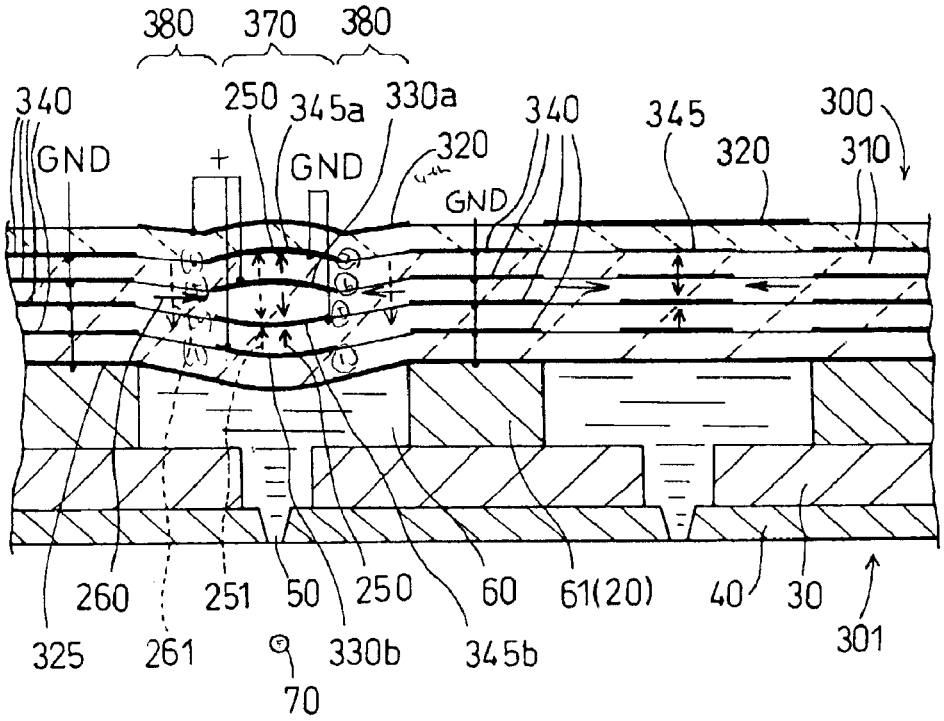
FIG. 15 is a sectional view showing the operation of an ink ejector modified from the ink ejector according to the second embodiment where the piezoelectric transducer is locally deformed to eject an ink droplet.

FIG. 15 shows an ink ejector 301 modified from the ink ejector 201 of the second embodiment. Five piezoelectric ceramic layers 310 are laminated while first sets of electrodes 345*a*, 330*a*, 345*b*, 330*b* arranged in four layers are sandwiched therebetween, thereby forming a piezoelectric transducer 300. Electrodes 340 are also provided in four layers on both sides of each first set of electrodes 345, 330. Outer electrodes 320, 325 are formed on outer surfaces of the outermost piezoelectric ceramic layers 310. Sub-areas defined in a first area 370 by a first set of electrodes 345, 330 are polarized, as shown by solid arrows 250 in FIG. 15, in opposite directions alternately in the laminating direction of the piezoelectric ceramic layers 310.

Two second areas 380, 380 adjacent to the first area 370 are polarized, as shown by solid arrows 260 in FIG. 15, in directions opposed to each other from the electrodes 340, 340 toward the first area 370, parallel to the plane of the piezoelectric ceramic layers 310. The manufacturing method of the piezoelectric transducer 300 is the same as that of the piezoelectric transducer 200, and thus a description thereof will be omitted.

When an ink droplet is to be ejected from a nozzle 50 connected to a selected ink channel 60 according to predetermined print data, a drive voltage (of +15 V, for example) is applied to the outer electrode 320 and alternate electrodes 330*a*, 330*b* of a first set of electrodes provided over the selected ink channel 60 while other electrodes 340, 345*a*, 345*b*, 325 are grounded. Upon the application of the drive voltage between the first set of electrodes 330, 345, electric fields are generated, as shown by dashed arrows 251, between the electrode 330*a* and the electrode 345*a*, between the electrode 330*a* and the electrode 345*b*, and between the electrode 345*b* and the electrode 330*b* in the same directions as the polarization directions 250. At the same time, upon the application of the drive voltage between the outer electrodes 320, 325, electric fields are generated, as shown in dashed arrows 261, perpendicular to the polarization directions 260. The piezoelectric transducer 300 differs from the piezoelectric transducer 200 of the second embodiment only in the number of laminated piezoelectric ceramic layers and the number of stacked electrodes of the first set of electrodes. Thus, the piezoelectric transducer 300 operates similarly to the piezoelectric transducer 200, and the drive voltage applied to the piezoelectric transducer 300 can be reduced likewise.

The piezoelectric transducer according to the above-described embodiments has a plurality of electrodes that define, over each ink channel, a first area and two second areas. The first area is substantially level with the two second areas. Upon the application of the drive voltage to the electrodes provided over a selected ink channel, the first area are deformed by a piezoelectric longitudinal effect and each of the second area is deformed by a piezoelectric shear effect. The first area and the two second areas are deformed symmetrically with respect to the center of the selected ink channel. Thus, the piezoelectric transducer is locally deformed effectively by combined effects. A required amount of deformation for ink ejection is obtained even when the spaces between the electrodes to which the drive voltage is applied are short. Accordingly, the drive voltage can be reduced, resulting in a reduction of costs of a power source and a driving circuit board.

While the invention has been described with reference to the specific embodiments, the description of the embodiments is illustrative only and is not to be construed as limiting the scope of the invention. Various other modifications and changes may be possible to those skilled in the art without departing from the spirit and scope of the invention. For example, the width of an ink channel in the array direction, the pitch of ink channels, the number of laminated piezoelectric layers, and the width and position of each inner electrode can be changed as required. A larger number of thinner piezoelectric ceramic layers can be laminated to form a piezoelectric transducer. Or, electrodes of a first set of electrodes may be shifted by one layer from the corresponding electrodes of a second set of electrodes.

What is claimed is:

1. A piezoelectric transducer, comprising:

a plurality of piezoelectric ceramic layers; and a plurality of electrodes spaced in a direction along a plane of the piezoelectric ceramic layers as well as in a thickness direction of the piezoelectric ceramic layers, the plurality of electrodes including:

a first set of electrodes spaced in the thickness direction of the piezoelectric ceramic layers and defining therebetween a first area that is polarized parallel to an opposing direction of electrodes of the first set and in the thickness direction of the piezoelectric ceramic layers, a second set of electrodes spaced in the direction along the plane and in the thickness direction of the piezoelectric ceramic layers, the second set of electrodes including electrodes substantially coplanar with the electrodes of the first set, and the second set of electrodes defining, between electrodes opposed in the direction along the plane of the piezoelectric ceramic layers, second areas that are polarized perpendicular to the opposing direction of the electrodes of the second set and in the thickness direction of the piezoelectric ceramic layers, the second areas being defined one on each side of the first area in the direction along the plane of the piezoelectric ceramic layer, and the second areas being substantially level with the first area, wherein upon application of a drive voltage to the first and second sets of electrodes, an electric field is generated in each of the second areas perpendicular to the polarization direction and each of the second areas is obliquely deformed by a piezoelectric shear effect to unidirectionally shift the first area, and an electric field is generated in the first area parallel to the polarization direction and the first area is deformed by a piezoelectric longitudinal effect to increase the thickness of the piezoelectric ceramic layers.

2. The piezoelectric transducer according to claim 1, wherein the first set of electrodes includes two opposed outermost electrodes and an odd number of electrodes interposed between the two opposed outermost electrodes, and the first area includes an even number of sub-areas that are polarized in opposite directions alternately in the thickness direction of the piezoelectric ceramic layers.

3. The piezoelectric transducer according to claim 2, wherein both edges of the two opposed outermost electrodes, which belong to the first set of electrodes, are adjacent to the second areas and are commonly used as part of the second set of electrodes.

4. The piezoelectric transducer according to claim 3, wherein the second set of electrodes includes a first part and a second part, the first part including the both edges of the two opposed outermost electrodes and electrodes interposed between the both edges of the two opposed outermost electrodes, and the second part including electrodes that are spaced from the first part in the direction along the plane of the piezoelectric ceramic layers and opposed to the first part across the two second areas.

5. The piezoelectric transducer according to claim 2, wherein the plurality of piezoelectric ceramic layers comprise at least four piezoelectric ceramic layers, and the two opposed outermost electrodes and the odd number of electrodes interposed therebetween are sandwiched between the piezoelectric ceramic layers symmetrically with respect to a center of the thickness of the piezoelectric ceramic layers, and the second set of electrodes are sandwiched between the piezoelectric ceramic layers.

6. An ink ejector, comprising:

a plurality of ink channels filled with ink and separated by partition walls, and a piezoelectric transducer comprising:

a plurality of piezoelectric ceramic layers extending across the plurality of ink channels; and a plurality of electrodes spaced in a direction along a plane of the piezoelectric ceramic layers as well as in a thickness direction of the piezoelectric ceramic layers, the plurality of electrodes including:

a first set of electrodes provided for each ink channel and spaced in the thickness direction of the piezoelectric ceramic layers, the first set of electrodes defining therebetween a first area that is located at substantially a center of each ink channel and polarized parallel to an opposing direction of electrodes of the first set and in the thickness direction of the piezoelectric ceramic layers; and a second set of electrodes provided for each ink channel and spaced in the direction along the plane and in the thickness direction of the piezoelectric ceramic layers, the second set of electrodes including electrodes substantially coplanar with the electrodes of the first set, and the second set of electrodes defining, between electrodes opposed in the direction along the plane of the piezoelectric ceramic layers, second areas that are located near both sides of each ink channel and polarized perpendicular to the opposing direction of the electrodes of the second set and in the thickness direction of the piezoelectric ceramic layers, the second areas being defined one on each side of the first area in the direction along the plane of the piezoelectric ceramic layer, and the second areas being substantially level with the first area, wherein upon application of a drive voltage to the first and second sets of electrodes for a selected one of the ink channels, an electric field is generated in each of the second areas perpendicular to the polarization direction and each of the second areas is obliquely deformed by a piezoelectric shear effect to unidirectionally shift the first area, and an electric field is generated in the first area parallel to the polarization direction and the first area is deformed by a piezoelectric longitudinal effect to increase the thickness of the piezoelectric ceramic layers, thereby changing a volume of the selected ink channel to cause ink ejection.

7. The ink ejector according to claim 6, wherein the first set of electrodes includes two opposed outermost electrodes and an odd number of electrodes interposed between the two opposed outermost electrodes, and the first area includes an even number of sub-areas that are polarized in opposite directions alternately in the direction of thickness of the piezoelectric ceramic layers.

8. The ink ejector according to claim 7, wherein both edges of the two opposed outermost electrodes, which belong to the first set of electrodes, are adjacent to the second areas and are commonly used as part of the second set of electrodes.

9. The ink ejector according to claim 8, wherein the second set of electrodes includes a first part and a second part, the first part including the both edges of the two opposed outermost electrodes and electrodes interposed between the both edges of the two opposed outermost electrodes, and the second part including electrodes that are spaced from the first part in the direction along the plane of the piezoelectric ceramic layers and opposed to the first part across the second areas.

10. The ink ejector according to claim 9, wherein the electrodes of the second part are placed on the partition walls on both sides of each ink channel, and half the electrodes of the second part placed on the partition wall on either side of each ink channel are commonly used for two adjacent ink channels.

11. The ink ejector according to claim 7, wherein the plurality of piezoelectric ceramic layers comprise at least four piezoelectric ceramic layers, and the two opposed outermost electrodes and the odd number of electrodes interposed therebetween are sandwiched between the piezoelectric ceramic layers symmetrically with respect to a center of the thickness of the piezoelectric ceramic layers, and the second set of electrodes are sandwiched between the piezoelectric ceramic layers.

12. A piezoelectric transducer, comprising:

a plurality of piezoelectric ceramic layers; and a plurality of electrodes spaced in a direction along a plane of the piezoelectric ceramic layers as well as in a thickness direction of the piezoelectric ceramic layers, the plurality of electrodes including:

a first set of electrodes spaced in the thickness direction of the piezoelectric ceramic layers and including two electrodes opposed in the thickness direction of the piezoelectric ceramic layers, the first set of electrodes defining therebetween a first area;

a second set of electrodes spaced in the direction along the plane of the piezoelectric ceramic layers and including electrodes substantially coplanar with the two opposed electrodes of the first set of electrodes, the second set of electrodes defining therebetween second areas, one on each side of the first area; and a third set of electrodes provided on outer surfaces of two outermost layers of the piezoelectric ceramic layers to sandwich at least the second areas, wherein the second areas are polarized perpendicular to the thickness direction of the piezoelectric ceramic layers and parallel to an opposing direction of electrodes of the second set, and the first area is polarized in the thickness direction of the piezoelectric ceramic layers, and upon application of a drive voltage to the third set of electrodes, an electric field is generated in each of the second areas perpendicular to the polarization direction and each of the second areas is deformed by a piezoelectric shear effect, and upon application of a drive voltage to the first set of electrodes, an electric field is generated in the first area parallel to the polarization direction and the first area is deformed, between the second areas being deformed, by a piezoelectric longitudinal effect.

13. The piezoelectric transducer according to claim 12, wherein both edges of the two opposed electrodes of the first set of electrodes are adjacent to the second areas and used as part of the second set of electrodes when the second areas are polarized by applying a polarizing voltage between the both edges of the two opposed electrodes and the second set of electrodes.

14. The piezoelectric transducer according to claim 12, wherein the plurality of piezoelectric ceramic layers comprise at least three piezoelectric ceramic layers, and the first set of electrodes and the second set of electrodes are sandwiched between the piezoelectric ceramic layers.

15. The piezoelectric transducer according to claim 14, wherein the first set of electrodes includes an even number of electrodes, and the first area defined by the first set of electrodes includes an odd number of sub-areas that are polarized in opposite directions alternately in the direction of thickness of the piezoelectric ceramic layers.

16. An ink ejector, comprising:

a plurality of ink channels filled with ink and separated by partition walls, and a piezoelectric transducer comprising:

a plurality of piezoelectric ceramic layers extending across the plurality of ink channels; and a plurality of electrodes spaced in a direction along a plane of the piezoelectric ceramic layers as well as in a thickness direction of the piezoelectric ceramic layers, the plurality of electrodes including:

a first set of electrodes provided for each ink channel and spaced in the thickness direction of the piezoelectric ceramic layers, the first set of electrodes including two electrodes opposed in the thickness direction of the piezoelectric ceramic layers, and the first set of electrodes defining therebetween a first area located at substantially a center of each ink channel;

a second set of electrodes provided for each ink channel and spaced in the direction along the plane of the piezoelectric ceramic layers, the second set of electrodes including electrodes substantially coplanar with the two opposed electrodes of the first set of electrodes, and the second set of electrodes defining therebetween second areas located near both sides of each ink channel, one on each side of the first area; and a third set of electrodes provided on outer surfaces of two outermost layers of the piezoelectric ceramic layers to sandwich at least the second areas, wherein the second areas are polarized perpendicular to the thickness direction of the piezoelectric ceramic layers and parallel to an opposing direction of electrodes of the second set, and the first area is polarized in the thickness direction of the piezoelectric ceramic layers, and upon application of a drive voltage to the third set of electrodes for a selected one of the ink channel, an electric field is generated in each of the second areas perpendicular to the polarization direction and each of the second areas is deformed by a piezoelectric shear effect, and upon application of a drive voltage to the first set of electrodes for the selected ink channel, an electric field is generated in the first area parallel to the polarization direction and the first area is deformed, between the second areas being deformed, by a piezoelectric longitudinal effect, thereby changing a volume of the selected ink channel to cause ink ejection.

17. The ink ejector according to claim 16, wherein both edges of the two opposed electrodes of the first set of electrodes are adjacent to the second areas and used as part of the second set of electrodes when the second areas are polarized by applying a polarizing voltage between the both edges of the two opposed electrodes and the second set of electrodes.

18. The ink ejector according to claim 16, wherein the plurality of piezoelectric ceramic layers comprise at least three piezoelectric ceramic layers, and the first set of electrodes and the second set of electrodes are sandwiched between the piezoelectric ceramic layers.

19. The ink ejector according to claim 18, wherein the first set of electrodes includes an even number of electrodes, and the first area defined by the first set of electrodes includes an odd number of sub-areas that are polarized in opposite directions alternately in the direction of thickness of the piezoelectric ceramic layers.

20. The ink ejector according to claim 16, wherein the third set of electrodes includes a plurality of electrodes provided, on the outer surface of an outermost layer far from the ink channels, to correspond to the plurality of ink channels, and an electrode provided, on the outer surface of an outermost layer near the ink channels, to extend across the plurality of ink channels.

21. The ink ejector according to claim 16, wherein the second set of electrodes includes electrodes placed on both sides of the partition walls of each ink channel, and half the electrodes placed on the partition wall of either side of each ink channel is commonly used for two adjacent ink channels.

22. A piezoelectric transducer, comprising:

a plurality of piezoelectric ceramic layers; and a plurality of electrodes spaced in a direction along a plane of the piezoelectric ceramic layers as well as in a thickness direction of the piezoelectric ceramic layers, the plurality of electrodes including:

a first set of electrodes spaced in the thickness direction of the piezoelectric ceramic layers and defining therebetween a first area that is polarized parallel to an opposing direction of electrodes of the first set and in the thickness direction of the piezoelectric ceramic layers, a second set of electrodes spaced in the direction along the plane and in the thickness direction of the piezoelectric ceramic layers, the second set of electrodes including electrodes substantially coplanar with the electrodes of the first set, and the second set of electrodes defining, between electrodes opposed in the direction along the plane of the piezoelectric ceramic layers, second areas that are polarized perpendicular to the opposing direction of the electrodes of the second set and in the thickness direction of the piezoelectric ceramic layers, the second areas being defined one on each side of the first area in the direction along the plane of the piezoelectric ceramic layer, and upper and lower surfaces of the second areas being substantially level with upper and lower surfaces of the first area, wherein upon application of a drive voltage to the first and second sets of electrodes, an electric field is generated in each of the second areas perpendicular to the polarization direction and each of the second areas is obliquely deformed by a piezoelectric shear effect to unidirectionally shift the first area, and an electric field is generated in the first area parallel to the polarization direction and the first area is deformed by a piezoelectric longitudinal effect to increase the thickness of the piezoelectric ceramic layers.

23. The piezoelectric transducer according to claim 22, wherein the first set of electrodes includes two opposed outermost electrodes and an odd number of electrodes interposed between the two opposed outermost electrodes, and the first area includes an even number of sub-areas that are polarized in opposite directions alternately in the thickness direction of the piezoelectric ceramic layers.

24. A piezoelectric transducer of an inkjet print head, comprising:

a plurality of piezoelectric ceramic layers extending over an ink channel and partition walls on both sides of the ink channel;

a plurality of electrodes spaced apart from each other vertically and laterally in the piezoelectric ceramic layers, the electrodes including:

a first set of electrodes including:

a first electrode overlying the ink channel;

a second electrode overlying the first electrode, the area between the first and second electrodes defining a first area;

a second set of electrodes overlying the partition walls on both sides of the ink channel and being stacked such that the second set of electrodes are coplanar with and spaced apart from the first set of electrodes to define a second area therebetween;

a third set of electrodes including:

a third electrode underlying the first electrode and contiguously overlying the ink channel and the partition walls on both sides of the ink channel;

a fourth electrode overlying the first and second areas and the second electrode;

wherein when a drive voltage to the first electrode relative to the voltage of the second electrode is applied, and a drive voltage to the fourth electrode relative to the voltage of the third electrode is applied, an electric field is generated in the first area that is parallel to the polarization direction of the first area and the first area is deformed by a piezoelectric longitudinal effect to change the thickness of a portion of the piezoelectric ceramic layers that overlies the ink channel, and an electric field is generated in the second area that is perpendicular to the polarization direction of the second area and the second area is deformed by a piezoelectric shear effect to unidirectionally shift the first area.

25. The piezoelectric transducer according to claim 24, wherein the first set of electrodes further includes:

a fifth electrode; and a sixth electrode overlying the fifth electrode, the fifth and sixth electrodes being disposed between the first electrode and the second electrode;

wherein when a drive voltage to the sixth electrode relative to the voltage of the fifth electrode is applied, an electric field between the fifth and sixth electrodes is generated in the first area that is parallel to the polarization direction of the first area.

* * * * *